US007878038B2

(12) United States Patent
Anagnostopoulos

(10) Patent No.: US 7,878,038 B2
(45) Date of Patent: Feb. 1, 2011

(54) SYSTEM AND PROCESS FOR PRODUCTION OF THREE-DIMENSIONAL PRODUCTS FROM WIRE

(76) Inventor: Antonios Anagnostopoulos, Bitsi Street 1, Kifissia, Attikis (GR) GR-14562

( * ) Notice: Subject to any disclaimer, the term of this patent is extended or adjusted under 35 U.S.C. 154(b) by 451 days.

(21) Appl. No.: 11/861,277

(22) Filed: Sep. 25, 2007

(65) Prior Publication Data

US 2008/0078226 A1 Apr. 3, 2008

(30) Foreign Application Priority Data

Oct. 3, 2006 (GR) ..... 060100545

(51) Int. Cl.
*B21D 11/14* (2006.01)
*B21F 7/00* (2006.01)

(52) U.S. Cl. ..... 72/299; 72/306; 72/307; 140/149

(58) Field of Classification Search ..... 72/295, 72/298, 299, 306, 307, 387, 388, 31.11, 129, 72/131; 140/149, 140
See application file for complete search history.

(56) References Cited

U.S. PATENT DOCUMENTS

| | | | | |
|---|---|---|---|---|
| 813,215 | A * | 2/1906 | Juengst | 140/140 |
| 3,922,901 | A * | 12/1975 | Hillegas et al. | 72/298 |
| 4,656,860 | A * | 4/1987 | Orthuber et al. | 72/307 |
| 4,799,373 | A | 1/1989 | Benton | |
| 5,088,310 | A | 2/1992 | Anagnostopoulou | |
| 5,170,654 | A | 12/1992 | Anagnostopoulos | |
| 5,363,681 | A * | 11/1994 | Speck et al. | 72/129 |
| 6,397,900 | B1 * | 6/2002 | Sautter et al. | 72/131 |
| 6,813,922 | B2 * | 11/2004 | Etienne | 72/307 |
| 7,240,528 | B2 * | 7/2007 | Weise et al. | 72/31.11 |
| 2003/0115925 | A1 * | 6/2003 | Harman et al. | 72/307 |
| 2005/0103080 | A1 | 5/2005 | Anagnostopoulos | |

FOREIGN PATENT DOCUMENTS

| | | | |
|---|---|---|---|
| EP | 231092 | A2 | 8/1987 |
| WO | 03/103874 | A1 | 12/2003 |

OTHER PUBLICATIONS

Automated Industrial Machinery, Inc.; "AccuForm Modular" brochure, Series AFM-3D; 2007 copyright.
EPO, Extended Search Report dated Feb. 4, 2008, 8pp., European Application No. 07117186.2.

* cited by examiner

*Primary Examiner*—David B Jones
(74) *Attorney, Agent, or Firm*—George Kapsalas; Patenbuero Paul Rosenich AG

(57) ABSTRACT

A process of production of three-dimensional products from wire (1) or other suitable material, which process may be implemented in a system (8) that may include an advancement mechanism (9), a straightening mechanism (11), a length measuring arrangement (18) towards which advances the material (1), a gripper arrangement (14) suitable to hold the material with fixed grippers (15) and simultaneously with other grippers (16) to twist it to a desired angle around its longitudinal axis (X), and a rotatable bending mechanism (12) that can bend the material plastically in one plane and simultaneously can rotate at a desired angle around the longitudinal axis (X) of the wire (1) so that it may generate bends in different planes. The system (8) implementing the process may also carry a cutting arrangement (13). The process of production of three-dimensional products affords the ability of choosing and energizing within the same product shape either the gripper arrangement (14) or the bending mechanism (12) thus providing the flexibility of bettering the times of production of various three-dimensional shapes.

20 Claims, 4 Drawing Sheets

SYSTEM AND PROCESS FOR PRODUCTION OF THREE-DIMENSIONAL PRODUCTS FROM WIRE

This application claims foreign priority under 35 U.S.C. 119 to prior Greek (GR) National Application No. 20060100545 filed on Oct. 3, 2006, the entire contents of which are hereby incorporated herein by reference.

BACKGROUND OF THE INVENTION

1. Field of the Invention

The invention relates to systems and processes of production of three-dimensional products from wire, rods, rebar, or other suitable similar or elongate material of any cross-section capable of undergoing plastic deformation. The three-dimensional products may find use in a broad variety of applications and cover a very large spectrum of shapes.

2. Description of Related Art

Prior U.S. Pat. No. 5,170,654 dated Dec. 15, 1992 disclosed an automatic bending machine permitting the production of some three-dimensional products from wire. With reference to FIG. 1 of this prior patent, a bending mechanism 6 bends the wire in a plane, and a cutter 7 is used for cutting the formed product from the wire. Furthermore, a fixed gripper 8 and a rotating gripper 9 comprise a gripper arrangement functioning to hold the material with fixed gripper 8 and simultaneously rotate the material about its longitudinal axis X with the rotating gripper 9. This is explained at columns 3-5 of U.S. Pat. No. 5,170,654, the entire contents of which are hereby incorporated herein by reference.

A radically different solution to the problem of producing three-dimensional products from wire, tubing, or other elongate material was given in U.S. Pat. No. 4,799,373 dated Jan. 24, 1989 to Benton. With regard to FIG. 1 of this prior patent, a bending mechanism 20 may bend the wire in one plane and may rotate in its entirety about the longitudinal axis of the material 24, in both directions as indicated in FIG. 1 thereof, and as explained at column 4, lines 40-54 of this prior patent. A cutter 76 is included. As explained at column 1, lines 34-36, this machine permits the production of some three-dimensional products from wire, tubing, or other elongate material.

Thus, it may be understood that previously, three-dimensional products were produced in the following ways:

(a) With reference to FIG. 3 of the appended drawings, the products were produced with the aid of automatic machines which include an arrangement of advancement mechanism 3, system for straightening 4, system for measuring of advanced length 17, a bending mechanism 5 that is fixed and bends the wire 1 in one plane thereby generating only planar forms, and which automatic machines include a mechanism 7, that is found between the straightener 4 and the bending mechanism 5 and that holds the material with suitable grippers and simultaneously with other grippers twists it around its longitudinal axis X. A system for cutting 6 of the wire 1 may typically be included.

(b) With reference to FIG. 4 of the appended drawings, the products were produced with the aid of automatic machines which include an arrangement of advancement mechanism 3, straightener 4, a system for measuring of advanced length 17, and a bending mechanism 10 that may bend the wire 1 in one plane and afterwards may rotate in its entirety around the longitudinal axis X of the wire 1 and effect bending again in another plane. Furthermore, a system 6 for cutting the wire 1 may typically be included.

In the first process (a) referred to above, and in automatic machines of this first type, for the generation of the third dimension the material is twisted around its own longitudinal axis X, so that the already-produced portion of the shape comes to the suitable desired angle in relation to the bending tools. There follows the bending to generate the new plane in the product. This way is advisable for the generation of small sides because of the speed that characterizes it. However, for the generation of large sides, such a twisting of the material has the disadvantage that it must occur quite slowly, because the large moment of inertia of the material of the already-produced portion of the shape tends to induce vibrations in, or to deform the already produced angles and sides.

In marked contrast, in the second process (b) referred to above, and in automatic machines of the second type, for the generation of the third dimension in the product, the entire bending mechanism 10 is rotated around the longitudinal axis X of the wire 1 so that the bending tools arrive at a suitable location for there to occur afterwards the bending of the material at the desired angle. This manner of controlled generation of bends in different selected planes within a single product form is advisable when it is necessary to generate large product sides, because it is not necessary, as in the first process (a) referred to above, to turn in its entirety the already produced shape by twisting it at suitable angle about the material's longitudinal axis X.

A great disadvantage in each of the above-described state-of-the-art processes and in machines of the first and second types is that each one of them respectively provides only one respective way for generating the third dimension in a shape. This entails great limitations primarily as to productivity, taking into consideration that the in-question products typically must be produced in very large numbers. It may be readily understood that with shapes that have both large and small sides, whichever process is employed has the consequence of significant delay in production. That is because with the first process, and automatic machines of the first type (a), the delay will occur during the generation of the large sides; while in the second process and automatic machines of the second type (b) the delay will occur during the generation of the small sides of the product space as the entire bending mechanism is rotated.

SUMMARY OF THE INVENTION

A process according to the present invention and an exemplary system that implements it, as presented herein, effect the automated production of three-dimensional products from wire, rod, rebar, or other suitable material of any cross-section able to undergo plastic formation, and provide the possibility, for each segment or portion of the under-production product, of selecting the faster and best manner of production according to product geometry and dimensions. The invention provides for the first time the breakthrough coexistence, within one system, of an arrangement capable of rotating the material about its own axis to select planes for bending, and a rotatable bending mechanism capable of rotating about the axis of the material to select planes for bending, thus providing the heretofore unenvisioned and unknown capability of selectively choosing and energizing within the same product shape one or the other of this duo according to the geometry and the dimensions of the different portions of the under-production shape. This uniquely imparts the flexibility to improve times of production of the different product shapes produced.

In relation to the enumerated disadvantages of the methods and machines that existed, explained above, and in contrast thereto, the present invention provides the following among its specific advantages. Taking into consideration that these three-dimensional products are usually produced in very large number:

Flexibility in production is significantly increased

The time for production of the three-dimensional products is significantly shortened.

The cost of production is reduced to a great degree.

Accordingly, it is an object of this invention to provide a system for producing three-dimensional products from wire, rods, rebar, or other suitable material, comprising: an advancement mechanism for the material; a rotatable bending mechanism for bending the material, said rotatable bending mechanism selectively rotatable around a longitudinal axis of the material to a selected angle to controllably select a plane in which the rotatable bending mechanism generates a corresponding selected bend of the material; and, a gripper arrangement configured to selectively twist the material about its longitudinal axis to controllably select a plane in which the rotatable bending mechanism generates a corresponding selected bend of the material.

It is a further object of this invention to provide a process for producing three-dimensional products from wire, rods, rebar, or other suitable material, comprising steps of: advancing the material; passing the material through a gripper arrangement configured to hold the material fixed at a first location and to simultaneously twist the material around its axis by gripping it at a second location; bending the material with a rotatable bending mechanism configured to selectively rotate around the longitudinal axis of the material to a selected angle to controllably select a plane in which the material is bent; and, choosing one of either, (a) twisting the material around its axis with the gripper arrangement, or, (b) rotating the rotatable bending mechanism about the axis of the material; to select a plane of bending.

More details about the systems and processes according to the present invention will be better comprehended in the immediately following detailed description of exemplary implementations of versions of the invention. The systems and processes are described in the attached figures, in the sense of non-restrictive examples and without limitation in the range of the applications of the machines and processes. These and other features, aspects, and advantages of the present invention will become better understood with regard to the following description, appended claims, and accompanying drawings, where:

DETAILED DESCRIPTION

Figure 1:
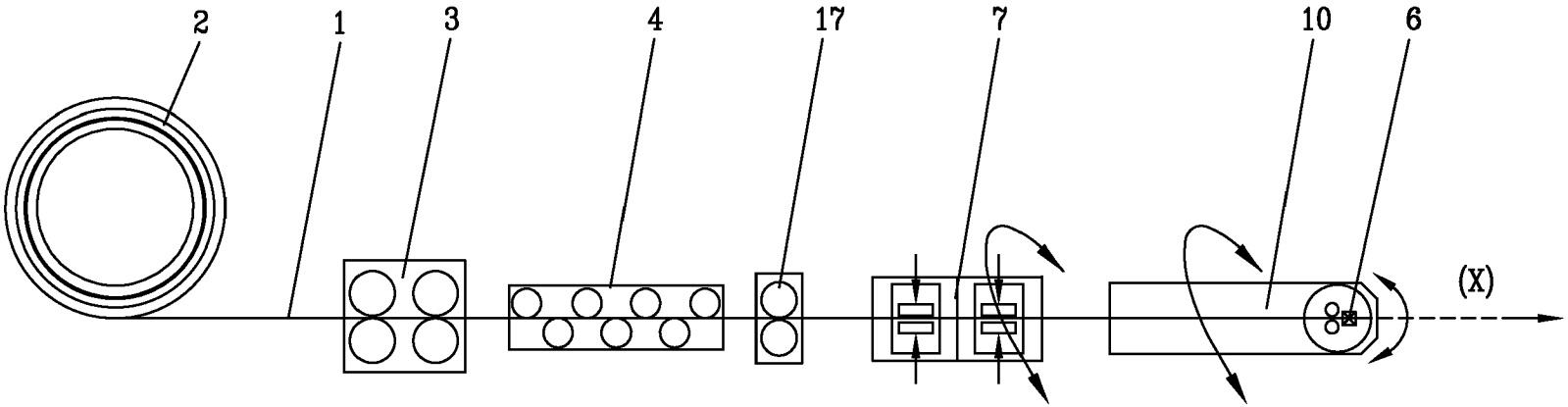
FIG. 1 depicts in idealization a process of production and its kinematic requirements, according to the present invention FIG. 2 schematically depicts an exemplary system that implements the process of production of three-dimensional products according to the present invention.

The process may be understood to comprise several steps. With reference to FIG. 1, the wire 1, rod, rebar, or other suitable material 1 able to undergo plastic deformation, originating from spool 2, is advanced 3, may be straightened 4, there may occur a measurement 17 of its length of the advanced material, and afterwards the material 1 passes sequentially from two arrangements 7, 10 of which the first 7 can hold the wire 1 and rotate it around the longitudinal axis X, while the second 10 can rotate around the longitudinal axis X of the wire 1, having the capability to bend the wire 1 at a desired and predetermined angle and to cut it 6. With this process, it is possible to effectively choose from these two ways of creating the third dimension in the entire product or in a portion thereof, the more suitable and faster, each time. Thus, with the flexibility afforded by this process one can significantly reduce the time of production of the product, independent of its shape, its dimensions and its other geometric characteristics.

Accordingly, the process may provide for production of three-dimensional products from wire 1, rod or other suitable material of any cross-section, originating from a spool 2, and capable of undergoing plastic deformation. The process may comprise advancement 3 of material 1, measuring 17 of the advanced length, and straightening 4. Bending is effected with a bending mechanism 10, that has the ability to rotate around the longitudinal axis X of the wire 1 and to controllably bend the material 1 plastically, at selected and predetermined angles in different planes that may be different amongst themselves within the same shape. A cutting 6 may occur upon completion of the three-dimensional product. The process may be characterized in that according to the form and individual geometric characteristics and the dimensions of the for-production three-dimensional product it is possible to generate bendings in different planes. For each portion of the for-production shape there is selected separately, either the rotatable bending mechanism 5 for generating a different-plane bending, or a gripper arrangement 7 via which is held fixed the wire 1 at one location and gripped at another location so as to be twisted around its longitudinal axis X, securing thus the most suitable and fastest manner of generation of individual portions of the product so as to improve the time for its production.

A process according to the aforegoing description may be further characterized in that the location of twisting of wire 1 is located after the location at which the material is held fixed.

Furthermore, a process according to the aforegoing description may be further characterized in that the twisting of wire 1 around its longitudinal axis X may be made with either right directional twist or left directional twist.

Figure 2:
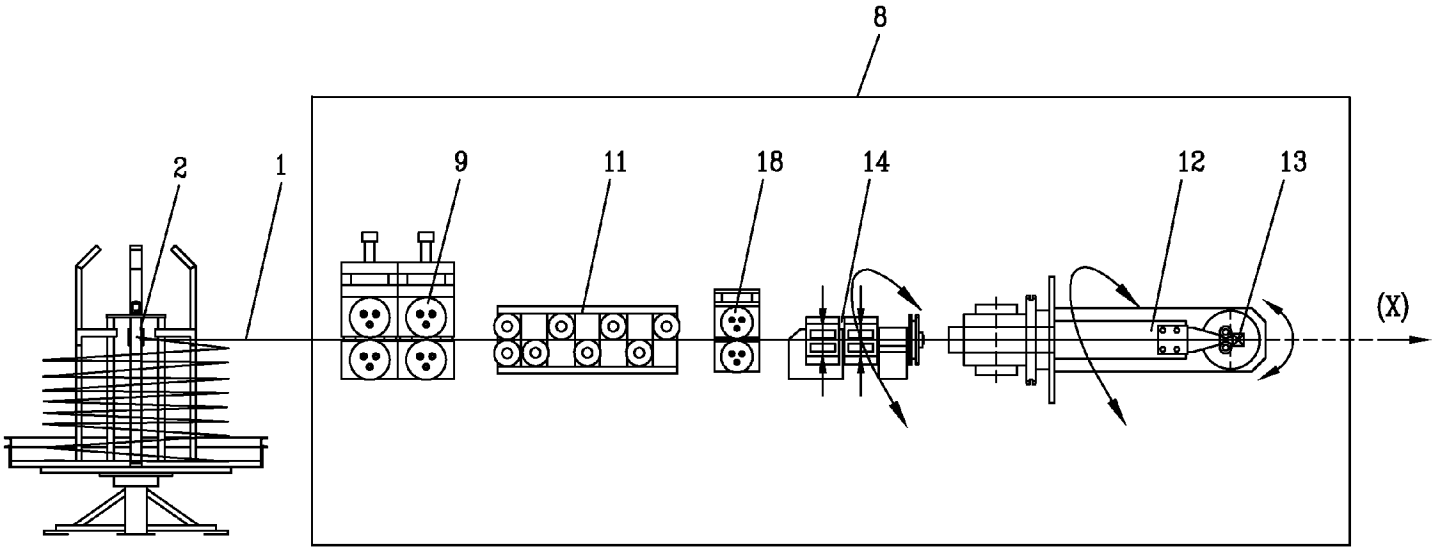
Figure 3:
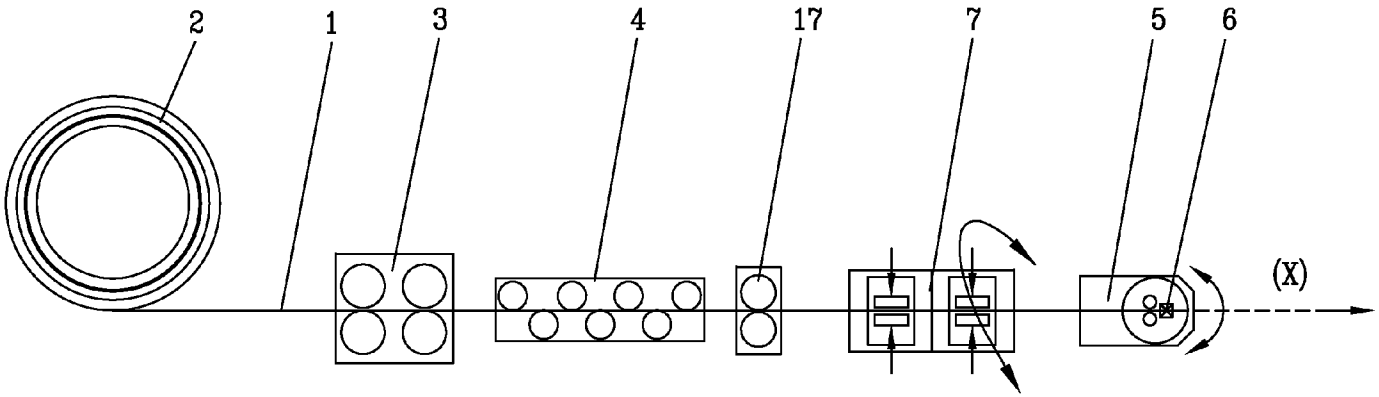
PRIOR ART FIG. 3
FIG. 3 depicts in idealization a first process of production of the three-dimensional products according to the prior art.
Figure 4:
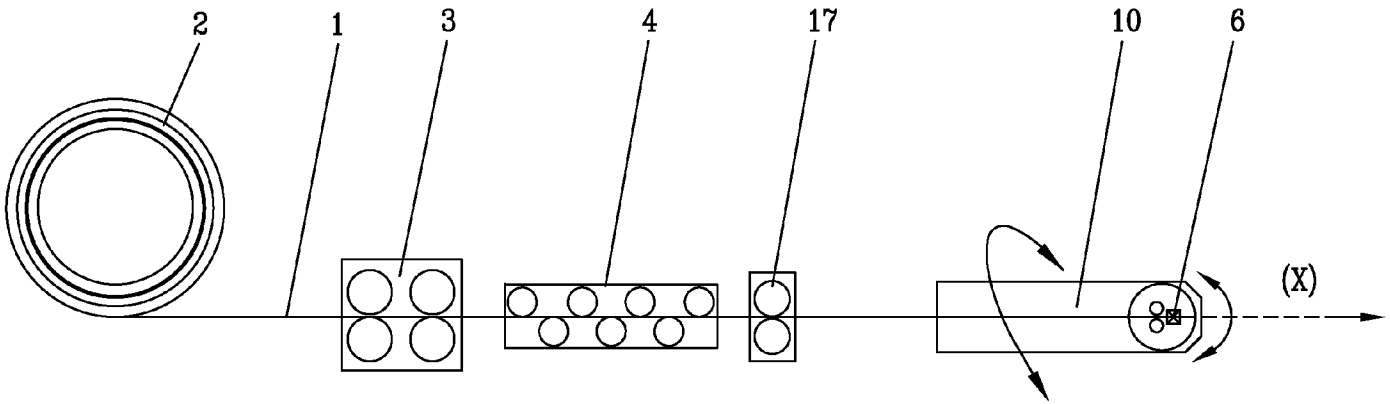
PRIOR ART FIG. 4
FIG. 4 depicts in idealization a second process of production of the three-dimensional products according to the prior art.

In further aspect, and with reference to FIGS. 1-2, the process may be implemented in an innovative system 8 which comprises an advancement mechanism 3,9 for wire 1 originating from spool 2. Also included are a straightening mechanism 11, 4 that straightens the wire 1; an arrangement 18, 17 for measuring length of the material advanced; a gripper arrangement 14, 7 able to hold the material with suitable stationary grippers 15 and simultaneously with other rotating grippers 16, that grip the material, to twist it at desired angle around its longitudinal axis X; a bending mechanism 12 that may bend the material plastically in one plane and may be controllably rotated at a suitable angle around the longitudinal axis X of the material 1, capable thus to controllably generate selected and predetermined bendings on different planes, which bendings may be different amongst themselves within the same shape; and a cutting arrangement 13, 6 that may be carried by the bending mechanism.

Accordingly, in a version of the invention there is provided a system 8 for the production of three-dimensional products from wire 1 or rod or other suitable material of any cross-section capable of undergoing plastic deformation. The system 8 may include an advancement mechanism 9 suitable for advancing the material originating from spool 2, a suitable straightening mechanism 11 that straightens the advancing material 1, and a length measuring arrangement 18 towards which advances the material. Also included are an arrangement of a bending mechanism 12 that can bend the material plastically on one plane and that may be rotated via a motor 19 to a desired angle around the longitudinal axis X of the wire 1, capable thus of generating at-will selected and predetermined bendings in different planes, which may be different amongst themselves within the same shape. The bending mechanism may include an arm, and the plastic bending may be effected with a rotatable bending head 20. As illustrated in FIG. 2, the rotatable bending mechanism 12 may carry a cutting arrangement 13 for the material. The system 8 is characterized in that between the straightening mechanism 11 and the bending mechanism 12, that bends the material in the plane and also in the product space, is interposed a gripper arrangement 14, able to hold the material with suitable stationary grippers 15 and simultaneously with other grippers 16 to twist it to a desired angle around the longitudinal axis X, deforming it plastically at a desired location, so that the bends that have been made by the bending mechanism 12 may change plane. Either the bending mechanism 12 rotation, or the arrangement 14 may be selectively energized via motors, at choice, according to the geometric characteristics of the for-production shape. Thus it is possible to produce three-dimensional products from wire 1 or other suitable material capable of undergoing plastic deformation, with the suitable and best choice of advancement, bending and torsion and with the best speed corresponding with the dimensions and the requirements of the shape, each time.

A system 8 according to the aforegoing description may be further characterized in that the gripper arrangement 14 that is able to hold steady the material with suitable fixed grippers 15 and simultaneously with other rotating grippers 16 to twist it to a desired angle around its longitudinal axis X to deform it plastically at a desired location, may be located between the straightening mechanism 11 and the bending mechanism 12.

Furthermore, an system 8 according to the aforegoing description may be further characterized in that the arrangement 14 holds steady the material with suitable grippers 15 and simultaneously with other grippers 16 may twist it to a desired angle around its longitudinal axis X with right directional twist or left directional twist.

Yet further, a system 8 according to the aforegoing description may be further characterized in that the supervision, the coordination and the control of all the functions of the process of production of the three-dimensional product are made by a suitable electronic computer, in which are entered the necessary characteristics of the for-production three-dimensional product.

The individual elements and mechanisms that comprise the system 8 according to the present invention may be arranged in series, so that the gripper arrangement 14 may be located between the straightening mechanism 11 and the bending mechanism 12.

As has been explained, the layout 8 according to the present invention may work wire 1, rods, rebar, or other suitable material of any cross section, able to undergo plastic deformation.

The coordination and control of all the functions of the process of production of the three-dimensional products are effected by a suitable electronic computer, in which are entered all necessary product characteristics for the production of the product and via which may be chosen in which portions of the product, which mechanism 12,14 shall be employed.

The present invention is not limited in any manner to the example described and in-the-drawing-portrayed implementation, but may be implemented in many forms and dimensions without departing from the scope and region of protection of the invention. Furthermore, in the implementation of the invention, the materials that are used as well as the dimensions of the individual elements may be in accordance with the requirements of the particular construction.

Various exemplary devices and methods have been illustrated in the accompanying drawings and described in the foregoing detailed description but it will be understood that the claims to the methods and devices shown and described are not limited to the particular embodiments described herein, as these may be capable of numerous rearrangements, modifications, and substitutions, and may be implemented in many forms and dimensions without departing from the scope and spirit of the claims set forth below. Consistent with legal precedent, the spirit and scope of the appended claims should not be limited to the description of the preferred versions contained herein. Accordingly, the techniques and structures described and illustrated herein should be understood to be illustrative only and not limiting upon the scope of the present invention. The scope of the present invention is defined by the appended claims, including known equivalents and unforeseeable equivalents at the time of filing of this application.

What is claimed is:

1. A system for producing three-dimensional products from wire, rods, rebar, or other suitable material, comprising:

an advancement mechanism configured to advance the material;

a rotatable bending mechanism configured to bend the material, said rotatable bending mechanism being selectively rotatable around a longitudinal axis of the material to a selected angle to controllably select a plane in which said rotatable bending mechanism generates a corresponding selected bend of the material; and, a gripper arrangement configured to selectively twist the material about its longitudinal axis to controllably select a plane in which said rotatable bending mechanism generates a corresponding selected bend of the material.

2. A system for producing three-dimensional products from wire, rods, rebar, or other suitable material as claimed in claim 1, further comprising:

said gripper arrangement including a stationary gripper; and, said gripper arrangement including a rotary gripper.

3. A system for producing three-dimensional products from wire, rods, rebar, or other suitable material as claimed in claim 1, further comprising:

said rotatable bending mechanism including a rotary bending head configured to generate bends in the material.

4. A system for producing three-dimensional products from wire, rods, rebar, or other suitable material as claimed in claim 3, further comprising:

a cutter located on said rotatable bending mechanism.

5. A system for producing three-dimensional products from wire, rods, rebar, or other suitable material as claimed in claim 1, further comprising:

a motor configured to selectively rotate said rotatable bending mechanism.

6. A system for producing three-dimensional products from wire, rods, rebar, or other suitable material as claimed in claim 1, further comprising:

a straightening mechanism for straightening the material.

7. The system for producing three-dimensional products from wire, rods, rebar, or other suitable material as claimed in claim 6, wherein:

said straightening mechanism is disposed between said advancement mechanism and said gripper arrangement.

8. The system for producing three-dimensional products from wire, rods, rebar, or other suitable material as claimed in claim 6, wherein:

said gripper arrangement is disposed between said straightening mechanism and said rotatable bending mechanism.

9. A system for producing three-dimensional products from wire, rods, rebar, or other suitable material as claimed in claim 1, further comprising:

a length-measuring arrangement configured to measure the length of material advanced.

10. A process for producing three-dimensional products from wire, rods, rebar, or other suitable material, comprising:

advancing the material;

passing the material through a gripper arrangement configured to hold the material fixed at a first location and to simultaneously twist the material around its axis by gripping it at a second location;

bending the material with a rotatable bending mechanism configured to selectively rotate around the longitudinal axis of the material to a selected angle to controllably select a plane in which the material is bent; and, choosing one of either, (a) twisting the material around its axis with the gripper arrangement, or, (b) rotating the rotatable bending mechanism about the axis of the material; to select a plane of bending.

11. The process for producing three-dimensional products from wire, rods, rebar, or other suitable material as claimed in claim 10, wherein:

said choosing one of either, (a) twisting the material around its axis with the gripper arrangement, or, (b) rotating the rotatable bending mechanism about the axis of the material; to select a plane of bending; is based on the characteristics of the three-dimensional product.

12. The process for producing three-dimensional products from wire, rods, rebar, or other suitable material as claimed in claim 10, wherein:

said choosing one of either, (a) twisting the material around its axis with the gripper arrangement, or (b) rotating the rotatable bending mechanism about the axis of the material; to select a plane of bending; is made based on the faster of (a) or (b) for generating an individual portion of the three-dimensional product.

13. A process for producing three-dimensional products from wire, rods, rebar, or other suitable material as claimed in claim 10, further comprising:

cutting the material.

14. A process for producing three-dimensional products from wire, rods, rebar, or other suitable material as claimed in claim 10, further comprising:

measuring the material advanced.

15. A process for producing three-dimensional products from wire, rods, rebar, or other suitable material as claimed in claim 10, further comprising:

straightening the material.

16. A system for producing three-dimensional products from wire, rods, rebar, or other suitable material, comprising:

an advancement mechanism configured to advance the material;

a straightening mechanism configured to straighten the advanced material;

a length-measuring arrangement configured to measure the length of advanced material;

a rotatable bending mechanism configured to bend the material, said rotatable bending mechanism being selectively rotatable around a longitudinal axis of the material to a selected angle to controllably select a plane in which said rotatable bending mechanism generates a corresponding selected bend of the material; and, a gripper arrangement configured to selectively twist the material about its longitudinal axis to controllably select a plane in which said rotatable bending mechanism generates a corresponding selected bend of the material;

said gripper arrangement including a stationary gripper configured to hold the material fixed at a first location; and, said gripper arrangement including a rotary gripper configured to grip said material at a second location and twist it around its axis.

17. A system for producing three-dimensional products from wire, rods, rebar, or other suitable material as claimed in claim 16, further comprising:

a cutter located on said rotatable bending mechanism.

18. A system for producing three-dimensional products from wire, rods, rebar, or other suitable material as claimed in claim 16, further comprising:

said rotatable bending mechanism including a rotary bending head configured to generate bends in the material.

19. The system for producing three-dimensional products from wire, rods, rebar, or other suitable material as claimed in claim 16, wherein:

said straightening mechanism is disposed between said advancement mechanism and said gripper arrangement.

20. The system for producing three-dimensional products from wire, rods, rebar, or other suitable material as claimed in claim 16, wherein:

said gripper arrangement is disposed between said straightening mechanism and said rotatable bending mechanism.

* * * * *